US010199740B2

(12) United States Patent
Hao

(10) Patent No.: US 10,199,740 B2
(45) Date of Patent: Feb. 5, 2019

(54) LENS DESIGN METHOD AND RADIATION SOURCE SUBSTRATE

(71) Applicant: BAE Systems plc, London (GB)

(72) Inventor: Yang Hao, London (GB)

(73) Assignee: BAE Systems plc, London (GB)

( * ) Notice: Subject to any disclaimer, the term of this patent is extended or adjusted under 35 U.S.C. 154(b) by 0 days.

(21) Appl. No.: 15/327,084

(22) PCT Filed: Mar. 18, 2015

(86) PCT No.: PCT/GB2015/050788

§ 371 (c)(1),
(2) Date: Jan. 18, 2017

(87) PCT Pub. No.: WO2016/012745

PCT Pub. Date: Jan. 28, 2016

(65) Prior Publication Data

US 2017/0162944 A1 Jun. 8, 2017

(30) Foreign Application Priority Data

Jul. 24, 2014 (GB) ..... 1413125.4

(51) Int. Cl.

| | |
|---|---|
| ***H01Q 9/04*** | (2006.01) |
| ***H01Q 15/10*** | (2006.01) |
| ***H01Q 19/06*** | (2006.01) |
| ***H01Q 15/00*** | (2006.01) |
| ***H01Q 1/36*** | (2006.01) |

(52) U.S. Cl.

CPC ..... *H01Q 15/10* (2013.01); *H01Q 1/362* (2013.01); *H01Q 15/0046* (2013.01); *H01Q 15/0053* (2013.01); *H01Q 19/062* (2013.01)

(58) Field of Classification Search

CPC ..... H01Q 15/10; H01Q 1/362
See application file for complete search history.

(56) References Cited

U.S. PATENT DOCUMENTS

| | | | |
|---|---|---|---|
| 3,755,815 | A | 8/1973 | Stangel et al. |
| 6,335,710 | B1 | 1/2002 | Faulk et al. |
| 7,119,739 | B1 | 10/2006 | Struckman |
| 7,911,407 | B1 | 3/2011 | Fong et al. |
| 7,929,147 | B1 | 4/2011 | Fong |

(Continued)

FOREIGN PATENT DOCUMENTS

| | | | |
|---|---|---|---|
| CN | 102694232 | A | 9/2012 |
| EP | 2738878 | A1 | 6/2014 |

(Continued)

OTHER PUBLICATIONS

Wilcox "An Expansion Theorem for Electromagnetic Fields", Communication on Pure and Applied Mathematics, vol. IX, 115-134, California Institute of Technology, 1956.*

(Continued)

*Primary Examiner* — Dameon E Levi
*Assistant Examiner* — David Lotter
(74) *Attorney, Agent, or Firm* — Maine Cernota & Rardin

(57) ABSTRACT

A lens design method is disclosed for designing a lens to reshape an actual far-field radiation pattern of a radiation source, such as a spiral antenna, to a preferred far-field radiation pattern. The method comprises:—determining a preferred far-field radiation pattern of the radiation source;—deriving a corresponding near-field radiation pattern from the preferred far-field radiation pattern;—determining an actual near-field pattern of the radiation source;—mapping an electric field and a magnetic field of the actual near-field radiation pattern to the derived near-field radiation pattern using a transfer relationship, the transfer relationship comprising material parameters which characterize the lens; and,—determining the material parameters.

17 Claims, 7 Drawing Sheets

(56) References Cited

U.S. PATENT DOCUMENTS

| | | | | |
|---|---|---|---|---|
| 2004/0008149 | A1* | 1/2004 | Killen | H01Q 3/46 343/795 |
| 2005/0030240 | A1 | 2/2005 | Rawnick et al. | |
| 2007/0285322 | A1 | 12/2007 | Nyshadham et al. | |
| 2008/0238810 | A1 | 10/2008 | Winsor | |
| 2014/0320361 | A1* | 10/2014 | Liu | H01Q 19/06 343/755 |

FOREIGN PATENT DOCUMENTS

| | | | |
|---|---|---|---|
| WO | 2004008570 | A2 | 1/2004 |
| WO | 2013013467 | A1 | 1/2013 |

OTHER PUBLICATIONS

International Search Report and Written Opinion of PCT Application No. PCT/GB2015/050788, dated Jun. 19, 2015, 14 pages.

Yuya Akatsuchi, Takayuki Yamada, Kazuhiro Izui, Shinji Nishiwaki, Makoto Ohkado, Tsuyoshi Nomura: "Design of a far-infrared lens based on topology optimization", 10th World Congress on Structural and Multidisciplinary Optimization, May 19, 2013-May 24, 2013, XP002741165, Orlando, FL, Retrieved from: http//ww2.mae.ufl.edu/mdo/Papers/5326.pdf.

Wei Xiang Jiang Et Al: "Planar reflector antenna design based on gradiant-index metamaterials", Microwave and Millimeter Wave Technology (ICMMT), 2010 International Conference on, IEEE, Piscataway, NJ, May 8, 2010, pp. 431-433, XP031717221, ISBN: 978-1-4244-5705-2.

Search Report of Great Britain Application No. GB1413125.4, dated Jan. 9, 2015, 5 pages.

* cited by examiner

LENS DESIGN METHOD AND RADIATION SOURCE SUBSTRATE

RELATED APPLICATIONS

This application is a National Phase application filed under 35 USC § 371 of PCT Application No. PCT/GB2015/050788 with an International filing date of Mar. 18, 2015 which claims priority of GB Patent Application 1413125.4 filed Jul. 24, 2014. Each of these applications is herein incorporated by reference in its entirety for all purposes.

FIELD OF THE INVENTION

The present invention relates to a lens design method and a radiation source substrate.

BACKGROUND OF THE INVENTION

Antennas are well-known for communication and radar systems. Antennas act as a transducer between electromagnetic wave propagation in free space and guided electromagnetic wave propagation in transmission lines. It is possible to design antennas to concentrate the radiated electromagnetic energy in a principal direction and conversely receive electromagnetic energy from a principal direction.

The ability of an antenna to concentrate the transmitted energy in a particular direction is commonly known as directivity or gain. It is common to speak of gain as a function of angle or direction which leads to a so-called radiation pattern for a given antenna. The radiation pattern will typically comprise a main beam within which the majority of the electromagnetic energy is concentrated and a plurality of side lobes or minor beams which diminish in energy as the angular separation from the main beam increase.

The far-field radiation pattern, namely the radiation pattern far from the antenna where the wavefronts are substantially planar (and the E and H-field of the electromagnetic field are in phase) is a key design specification when creating an antenna. It is found that a highly directive antenna is usually bulky, heavy and often expensive. In situations where it is required to steer a beam, then phased antenna arrays are often employed, however scanning range is often angularly limited to avoid significant side lobes developing in the radiation pattern. Therefore, it is desirable to tailor a far-field radiation pattern for a given antenna.

SUMMARY OF THE INVENTION

In accordance with the present invention as seen from a first aspect there is provided a lens design method for designing a lens to reshape an actual far-field radiation pattern of a radiation source to a preferred far-field radiation pattern, the method comprising:

- determining a preferred far-field radiation pattern of the radiation source;
- deriving a corresponding near-field radiation pattern from the preferred far-field radiation pattern;
- determining an actual near-field pattern of the radiation source;
- mapping an electric field and a magnetic field of the actual near-field radiation pattern to the derived near-field radiation pattern using a transfer relationship, the transfer relationship comprising material parameters which characterise the lens;
- determining the material parameters.

Advantageously, the method provides for the characterisation of a lens to create a preferred far-field radiation pattern for a given source of electromagnetic radiation.

In an embodiment, the corresponding near-field radiation pattern is derived from the preferred far-field radiation pattern using a mathematical expansion of the electric (E) and magnetic (H) fields, such as a Wilcox expansion. The actual near-field radiation pattern of the radiation source may also be derived from the actual far-field radiation pattern using a similar mathematical expansion of the E and H-fields.

The actual near-field pattern is mapped to the near-field pattern derived from the preferred far-field pattern by satisfying boundary conditions for the E and H-fields, as required by Maxwell's equations. The transfer relationship preferably maps the E and H-field of the actual near-field radiation pattern ($E_Z$, $iH_Z$) to the derived near-field radiation pattern)($E^{(0)}{}_Z$, $iH^{(0)}{}_Z$) and comprises a transfer matrix, comprising tensor values of the required permittivity and permeability of the lens. The transfer relationship preferably comprises:

$$\begin{pmatrix} E_z \\ iH_z \end{pmatrix} = \begin{pmatrix} u\cos\phi & -u\sin\phi \\ v\sin\phi & v\cos\phi \end{pmatrix} \begin{pmatrix} E_z^{(0)} \\ iH_z^{(0)} \end{pmatrix}$$

where $\varepsilon_{TT}/v^2=\mu_{TT}/u^2=\varepsilon_{TT}{}^{(0)}$ and $\varepsilon_{ZZ}/u^2=\varepsilon_{ZZ}/v^2=\varepsilon_{ZZ}{}^{(0)}$, ε and μ representing the permittivity and permeability respectively, and Φ is the difference in polarisation angle between the respective field components, namely between $E_Z$ and $E^{(0)}{}_Z$, and between Hz and $H^{(0)}{}_Z$.

In accordance with the present invention as seen from a second aspect, there is provided a lens for reshaping an actual far-field radiation pattern of a radiation source to a preferred far-field radiation pattern, the lens being designed according to the method of the first aspect.

In accordance with the present invention as seen from a third aspect, there is provided a computer program product comprising computer program elements configured to execute the method of the first aspect.

Spiral antennas are widely used in airborne and satellite borne applications such as communications, broadcasting, navigation, remote sensing and globe system positioning due to the wide bandwidth and circular polarization properties of the antenna, which avoid the Faraday rotation effect when radio wave propagates through the ionosphere. In one particular configuration, as illustrated in FIG. 1 of the drawings, the spiral antenna 40 comprises two arms 41, 42 which spiral outwardly in a common plane from diametrically opposed positions with respect to the coordinate centre 43. This configuration of spiral antenna, which is also known as an Archimedean antenna, comprises a geometry which is specified by the start radius of the spiral arms ($r_1$), the end radius of the spiral arm ($r_2$), the width (w) of the spiral arms and the spacing (s) between the two arms 41, 42.

The Archimedean spiral antenna, hereinafter referred to simply as spiral antenna, has a bidirectional radiation pattern, whereby radiation generated by the antenna 40 propagates outwardly either side of the plane of the spiral, along an axis of the spiral. The radiation pattern (not shown) comprises two maxima along the axis of the antenna 40, one on each side of the spiral antenna. However, in practice one of them is redundant as only the radiation pattern propagating away from one side of the spiral antenna 40 is used in applications. As such, spiral antennas typically waste useful radiation energy. Moreover, it is found that the redundant radiation pattern often causes interferences to other components of an electronic system (not shown) disposed proximate thereto. These drawbacks are also typical of other forms of antenna, where it is desirable to concentrate or direct the generated radiation along a particular direction.

In an endeavour to improve the efficiency of antennas, including spiral antennas 40, and minimise unwanted interference, antennas are typically mounted within a housing 51, but spaced from a rear wall 51*a* of the housing 51. So-called cavity backed spiral antennas 50 may comprise absorbing materials or metamaterials (not shown), for example, disposed within the housing 51 between the spiral antenna 40 and the rear wall 51*a* to minimise interference. However, this does not improve the efficiency of the spiral antenna 40, since half of the radiated energy is simply absorbed within the material (not shown) and wasted, and such cavity backed antennas are often bulky and occupy a significant volume.

In order to capture and use the energy radiated rearwardly of the spiral antenna 40, it is known to mount a perfect electrical conductor (PEC) 52 within the housing at the rear of the spiral antenna 40. The active region of the spiral antenna, namely the radiative zones along the arms 41, 42, is approximately the area circled by one wavelength in perimeter, the length of which varies with frequency. Accordingly, in order to reflect the rearwardly propagating radiation outwardly of the housing 51, the PEC is typically formed into a truncated cone shape 52, as illustrated in FIG. 2 of the drawings. If the geometry of the cone 52 is suitably chosen, the radiation reflected from the cone 52 will interfere constructively with the forwardly propagating radiation from the spiral antenna 40. In this respect, it is required that the separation of the arms 41, 42 of the spiral antenna 40 from the surface of the cone 52 is maintained as $$h = \frac{\lambda}{4}.$$

A problem with such PEC cones 52 however, is that the resulting spiral antenna 40 has a poor bandwidth.

In accordance with the present invention as seen from a fourth aspect, there is provided a radiation source substrate for manipulating at least a portion of a radiation pattern of a radiation source, the substrate comprising material parameters which vary within the substrate to create a refractive index gradient for manipulating at least a portion of the radiation generated by the radiation source.

The substrate may comprise a host first material within which is disposed at least one second dispersed material, wherein a density of the at least one second dispersed material varies across the substrate to create the refractive index gradient.

In an embodiment, the substrate comprises a plurality of material parameters which are separated into a plurality of concentrically arranged regions of the substrate, the regions being centred on an axis of the radiation source and comprising a respective material parameter.

In an embodiment, the material parameters of the substrate are determined according to the method of the first aspect.

In accordance with the present invention as seen from a fifth aspect, there is provided a radiation generating arrangement, the arrangement comprising a substrate according to the fourth aspect and a radiation source disposed upon the substrate.

In an embodiment, the radiation source comprises a spiral antenna.

BRIEF DESCRIPTION OF THE DRAWINGS

Embodiments of the present invention will now be described by way of example only and with reference to the accompanying drawings, in which.

DETAILED DESCRIPTION

Figure 3:
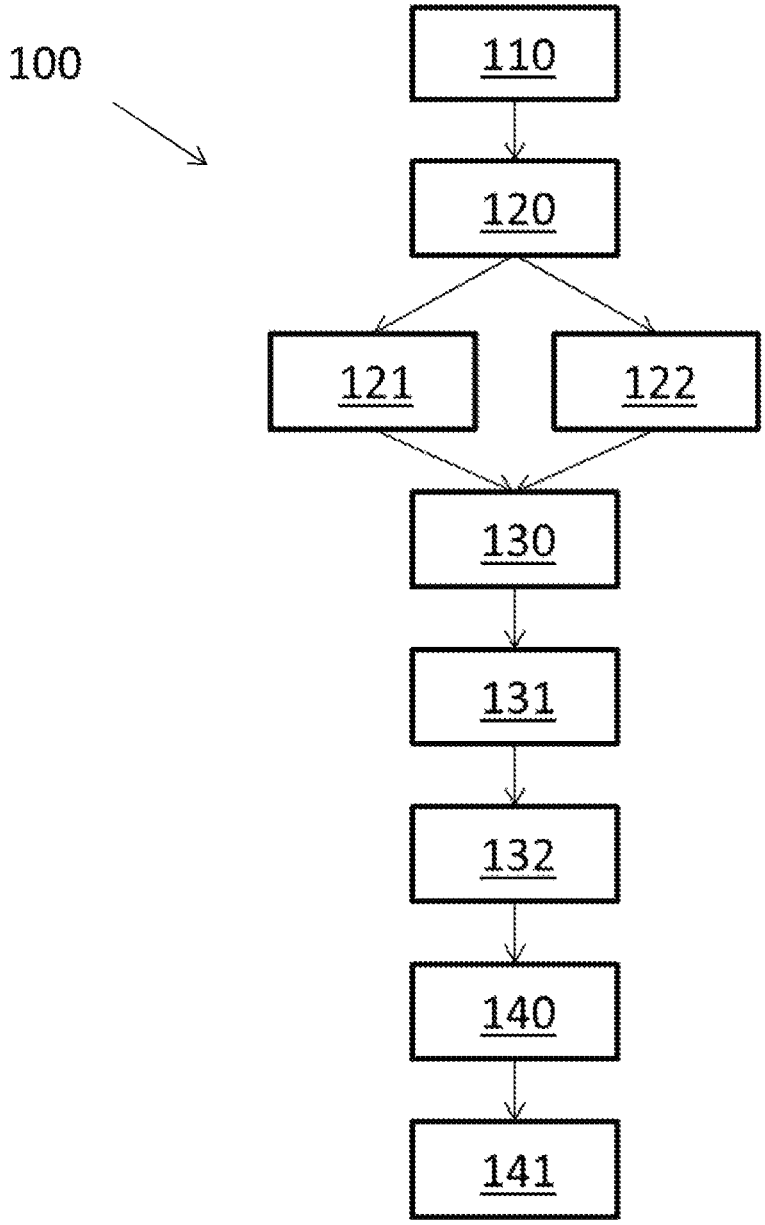
FIG. 3 is a schematic illustration of the steps associated with a method according to an embodiment of the present invention.

Referring to FIG. 3 of the drawings, there is provided a schematic illustration of a lens design method 100 according to an embodiment of the present invention, for designing a lens to reshape an actual far-field radiation pattern of a radiation source, such as an antenna or other radiation transmitting device, to a preferred far-field radiation pattern. The lens may be arranged to reshape the radiation pattern by reflecting the radiation in addition to refracting the radiation, and as such, the reshaping of the radiation may be achieved without the radiation passing through the lens. Accordingly, the terms "lens" is understood to comprise a substrate or superstrate, for example, which reflect the radiation, in addition to a more conventional understanding of a lens, in which the radiation passes therethrough. The term lens should therefore be construed as any material which facilitates a reshaping of the radiation pattern.

The method comprises determining the preferred far-field radiation pattern of the source at step 110 and then deriving a near-field radiation pattern from the preferred or desired far-field radiation pattern of the source at step 120.

The method 100 subsequently comprises transforming the actual near-field radiation pattern of the source to the derived near-field radiation pattern at step 130 by a transfer relationship that comprises material parameters which characterise the lens, and subsequently determining the material parameters at step 140.

Figure 4:
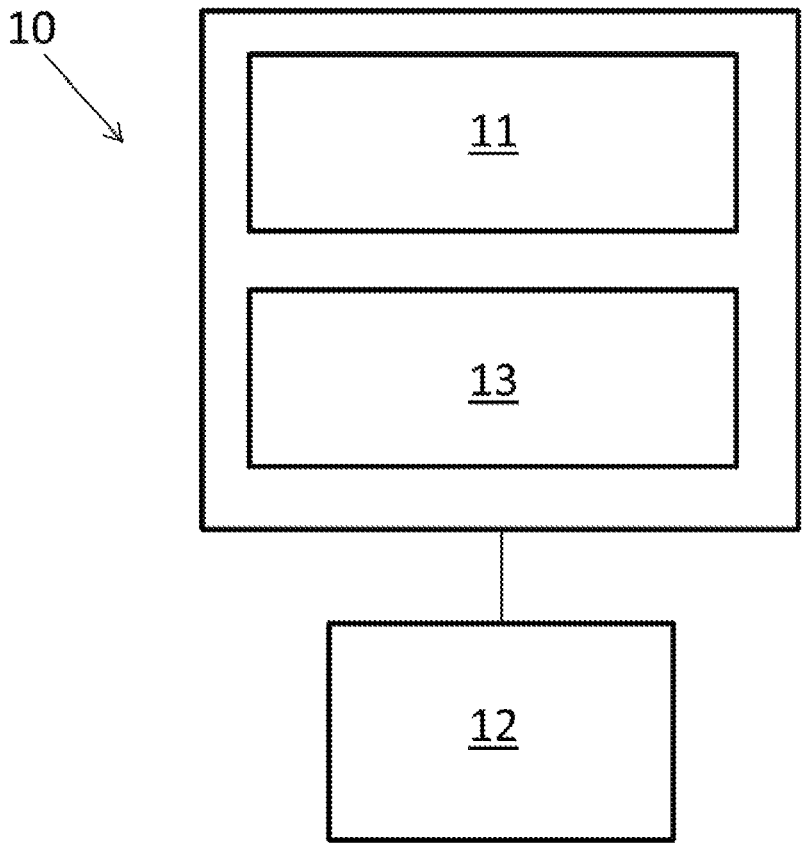
FIG. 4 is a schematic illustration of a computer configured to execute a program stored upon a computer program product according to an embodiment of the present invention.

Referring to FIG. 4 of the drawings, there is provided a schematic illustration of a computer 10 comprising a processor 11 which is configured to execute a computer program which implements the method 100 illustrated in FIG.

3. The characteristics of the preferred far-field radiation pattern, such as the gain, directivity, bandwidth, frequency and side lobe profile may be entered into the computer 10 at step 110, via an input device, such as a keyboard 12, or similar peripheral computer device and these characteristics are then used by the program which may be recorded upon a computer program product, such as a removable storage device or a memory 13 associated with the computer 10.

Figure 5:
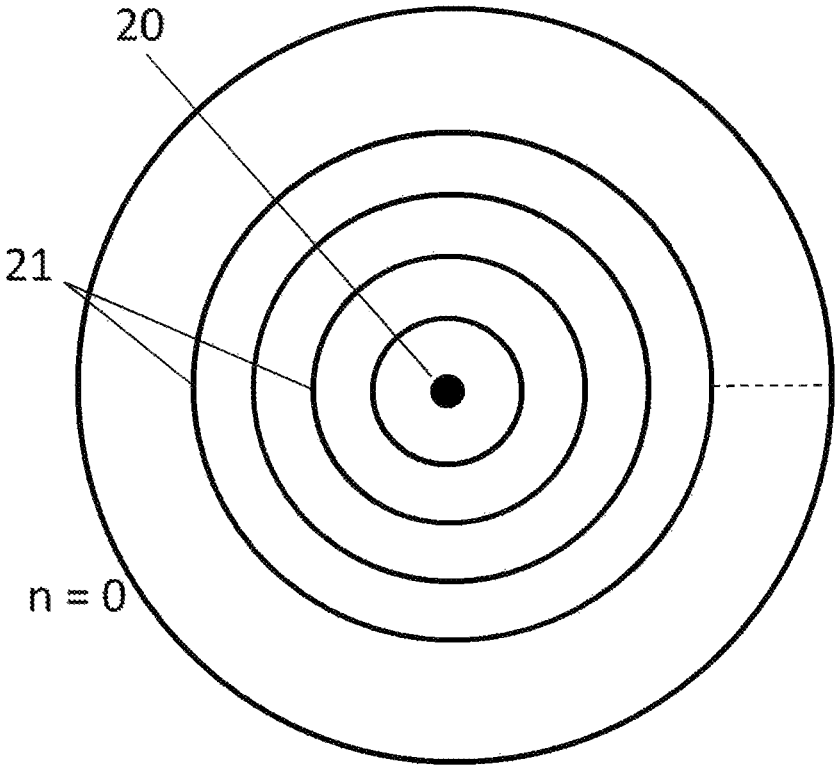
FIG. 5 is a schematic representation of an antenna illustrating the division of the space around the antenna into spherical shells.

The electromagnetic fields in the space surrounding a radiation source, such as an antenna, are known to satisfy the homogenous Hemholtz equation and so the electric and magnetic fields at a distance r from an antenna 20 (as illustrated in FIG. 5 of the drawings) can be expressed as a summed series as shown below:

$$E(r) = \frac{e^{ikr}}{r}\sum_{n=0}^{\infty}\frac{A_n(\theta,\varphi)}{r^n},\quad H(r) = \frac{e^{ikr}}{r}\sum_{n=0}^{\infty}\frac{B_n(\theta,\varphi)}{r^n} \tag{1}$$

where $A_n$ and $B_n$ are vector angular functions dependent on the far-field radiation pattern of the antenna, and $k=\omega(\varepsilon\mu)^{1/2}$ is the wavenumber. The series expansions in equation 1 are based on a model where the space surrounding the antenna 20 is divided into an infinite number of concentric, spherical shells 21 of increasing radius, with the antenna located at the centre, as illustrated in FIG. 5 of the drawings. The shells 21 are labelled with the variable n, with innermost shell ($n\rightarrow\infty$) defining the smallest shell 21 which surrounds the antenna 20 and the outermost shell (n=0) is identified with the far-field zone.

The far-field radiation pattern can be regarded as the asymptotic limits of the above series expansions and can be expressed as:

$$E(r) \underset{r\to\infty}{\sim} \frac{e^{ikr}}{r}\frac{A_o(\theta,\varphi)}{r},\quad H(r) \underset{r\to\infty}{\sim} \frac{e^{ikr}}{r}\frac{B_o(\theta,\varphi)}{r} \tag{2}$$

Equation 2 is the zeroth-order term of a Wilcox expansion, however, it is to be appreciated that other mathematical expansions may be used, for example with a spectral approach, the Weyl expansion may be used. The Wilcox expansion provides a spatial domain analysis, and the boundaries between the various shells are not strictly defined, but taken only as indicators in the asymptotic sense.

The angular vector of the electric field $A_n$ (and analogously, the magnetic field $B_n$) can be represented as:

$$A_o(\theta,\varphi) = \eta\sum_{l=0}^{\infty}\sum_{m=-l}^{l}\frac{(-i)^{l+1}}{k}[a_E(l,m)X_{lm} - a_M(l,m)\hat{r}\times X_{lm}], \tag{3}$$

$$A_n(\theta,\varphi) = \eta\sum_{l=n}^{\infty}\sum_{m=-l}^{l}a_E(l,m)b_n^l X_{lm} + \eta\sum_{l=n-1}^{\infty}\sum_{m=-l}^{l}\frac{ia_M(l,m)}{k}(c_n^l\hat{r}Y_{lm} + d_n^l\hat{r}\times X_{lm}]$$

where $X_{lm}$ is the vector spherical harmonic denoted by l, m, $\eta=(\mu/\varepsilon)^{1/2}$ is the wave impedance and $a_E(l, m)$ and $a_M(l, m)$ are the coefficients of the expansion of the transverse electric and magnetic modes ($TE_{lm}$, $TM_{lm}$), respectively.

The relations illustrated in equation 3 provide for a relationship between the far-field pattern and the entire space surrounding the antenna 20, namely a relationship between the far-field and the near-field. In this respect, the Wilcox series is derived from the multipole expansion and the variation of the angular vector fields $A_n$ and $B_n$ are directly determinable in terms of the spherical far-field modes of the antenna. Accordingly, the derivation of the near-field radiation patter at step 120 is mathematically described as a series of higher-order TE and TM modes, those modes being uniquely derived by the content of the far-field radiation pattern.

In an embodiment, the derivation of the actual near-field radiation pattern from the actual far-field pattern is obtained at step 121 using a similar method to that at step 110. In an alternative embodiment, the derivation of the actual near-field radiation pattern may be directly determined at step 122 by making suitable measurements. Once the actual near-field radiation pattern is known, the near-field variation of the E and H-field around the antenna is mapped or transformed to the derived near-field radiation pattern (which ultimately generates the preferred far-field radiation pattern) at step 130.

For a 2-dimensional, in-plane electromagnetic wave propagating in the x-y plane, then assuming that the material properties of the lens and the E and H-field parameters are invariant in the z-direction, Maxwell's equations (in Heaviside-Lorentz units) can be expressed as:

$$\nabla\times(\mu_{TT}^{-1}\cdot\nabla\times\hat{z}E_Z)=k_0^2\varepsilon_{ZZ}\hat{z}E_Z,\ \nabla\times(\varepsilon_{TT}^{-1}\cdot\nabla\times\hat{z}H_Z)= k_0^2\mu_{ZZ}\hat{z}H_Z \tag{4}$$

where $\mu_{TT}$ and $\varepsilon_{TT}$ are 2×2 symmetric tensors for the transverse permittivity and permeability, respectively and $k_0$ is the wave number in a vacuum. The derived near-field radiation pattern, as represented by the E and H-field parameters ($E^{(0)}_Z$, $iH^{(0)}_Z$) can then be mapped to the actual E and H-field ($E_Z$, $iH_Z$) of the antenna source by a 2×2 transfer matrix relation at step 131, as shown below:

$$\begin{pmatrix} E_z \\ iH_z \end{pmatrix} = \begin{pmatrix} u\cos\phi & -u\sin\phi \\ v\sin\phi & v\cos\phi \end{pmatrix}\begin{pmatrix} E_z^{(0)} \\ iH_z^{(0)} \end{pmatrix} \tag{5}$$

where $\varepsilon_{TT}/v^2=\mu_{TT}/u^2=\varepsilon_{TT}^{(0)}$ and $\varepsilon_{ZZ}/u^2=\varepsilon_{ZZ}/v^2=\varepsilon_{ZZ}^{(0)}$, and $\Phi$ is as defined above.

Maxwell's equations are still valid on the transformed fields ($E_Z$, $iH_Z$), within any physical medium which satisfies equation 5, namely any lens having a medium which comprises the required variation in permittivity and permeability as specified by the respective tensor matrix.

Figure 6:
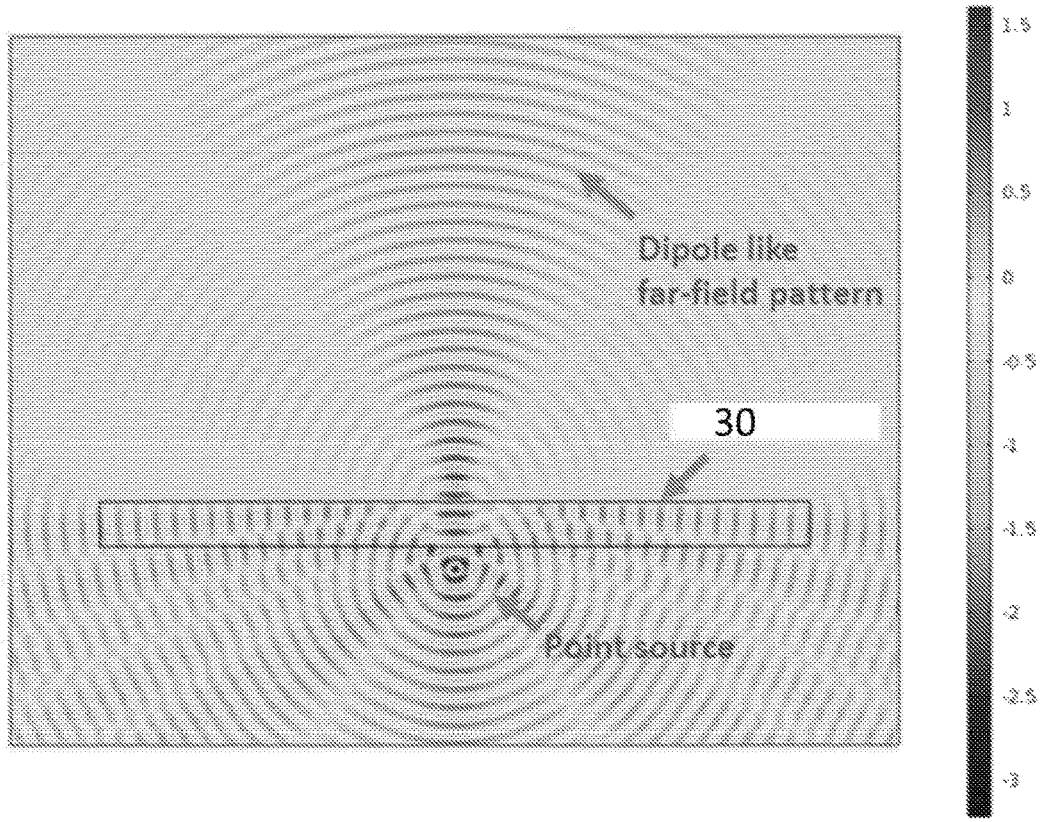
FIG. 6 is a density plot of the E-field radiation pattern from a point source antenna, illustrating the reshaping of the E-field pattern by a flat lens according to an embodiment of the present invention.

The near-field radiation pattern comprises a more complicated field pattern compared with the far field pattern owing to the reactive nature of the E and H-field proximate the antenna. In order to sufficiently map the derived near-field radiation pattern to the actual near-field radiation pattern of the antenna, it is beneficial to represent the physical domain across which the mapping occurs, namely the lens 30 (as illustrated in FIG. 6 of the drawings), with a discretely distorted grid at step 132, with a suitably fine discretisation to ensure a valid transformation of the fields between the actual and derived values. The grid is a numerically generated mesh which extends over the physical region and is designed to provide a link between the source field and the desired near field components which are derived from the field transformation.

The material parameters for the lens 30 are determined at step 140 from the calculated values of ε and μ, and thus u and v. The parameters are output as a representative signal to the processor 11 which subsequently interrogates a catalogue of various values of ε and μ and the corresponding material composition stored in the memory at step 141, to determine a material composition of the lens which provides the desired field transformation. The physical dimensions of the lens 30 are then chosen at step 142 depending on the preferred physical requirements of the antenna beam and/or receiving aperture, for example.

Referring to FIG. 6 of the drawings, there is illustrated a flat lens 30 designed according to the above described method 100. The lens 30 is shown to provide a preferred dipole like far-field radiation pattern from a point source antenna. It is thus evident that the method 100 of the present invention provides for a manipulation of antenna radiation, such that a preferred far-field pattern may be created for an arbitrary source of electromagnetic radiation.

Referring to FIG. 7*a* of the drawings, there is illustrated a radiation source substrate 60 according to an embodiment of the present invention, for manipulating at least a portion of a radiation pattern of a radiation source 70.

FIG. 7*b* illustrates a radiation generating arrangement 80 according to an embodiment of the present invention, which comprises the substrate 60 illustrated in FIG. 7*a* disposed within a metallic housing 81 and a radiation source 70, such as a spiral antenna, disposed upon the substrate 60. There are two principal differences between the arrangement 80 illustrated in FIG. 7*b* and the cavity backed antenna 50 illustrated in FIG. 2. The first principal difference is the thickness of the respective device. The thickness of the arrangement 70 illustrated in FIG. 7*b* is approximately half that of the cavity backed antenna 50 illustrated in FIG. 2. The other difference relates to the properties of the materials within the respective housing 51, 81, namely the space between the radiation source/antenna 60, 40 and the housing 81, 51. In the cavity backed antenna 50 illustrated in FIG. 2, the space between the spiral antenna 40 and the housing 51 is filled with air, whereas in the arrangement 80 illustrated in FIG. 7*b*, the cavity comprises a substrate 60 having material parameters which vary within the substrate 60 to create a refractive index profile for manipulating at least a portion of the radiation generated by the radiation source 70.

Figure 1:
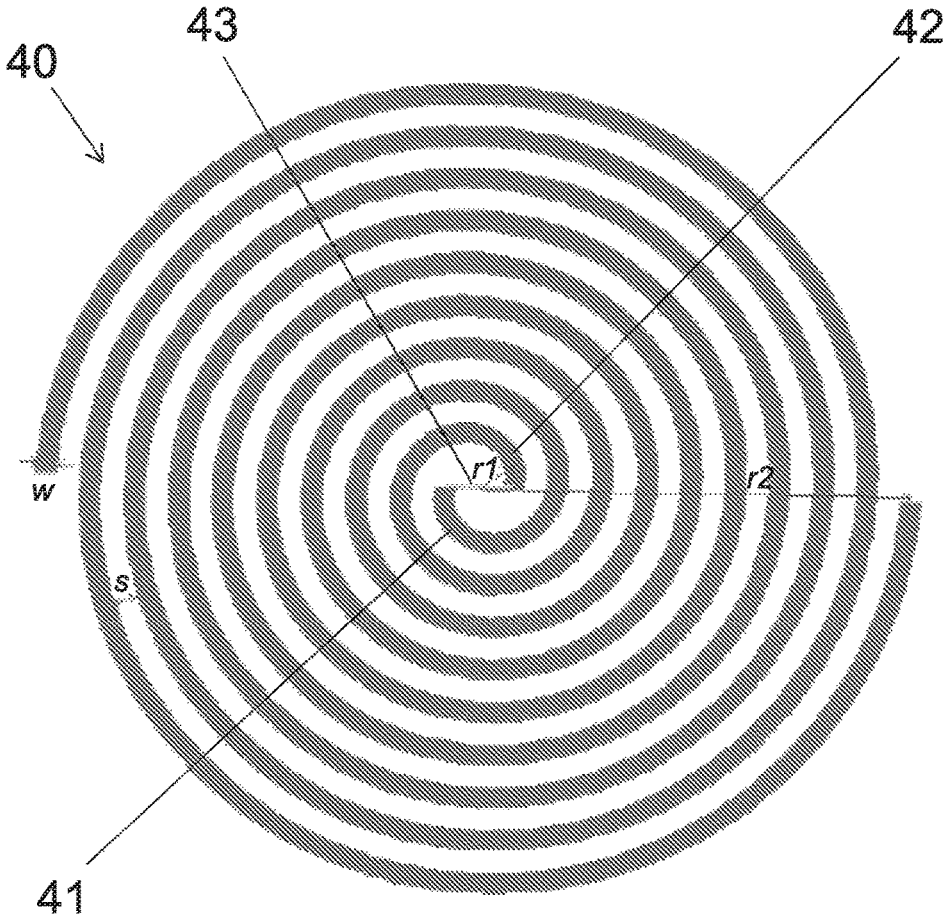
Figure 1 Prior Art
FIG. 1 is a schematic illustration of an Archimedean spiral antenna.
Figure 2A:
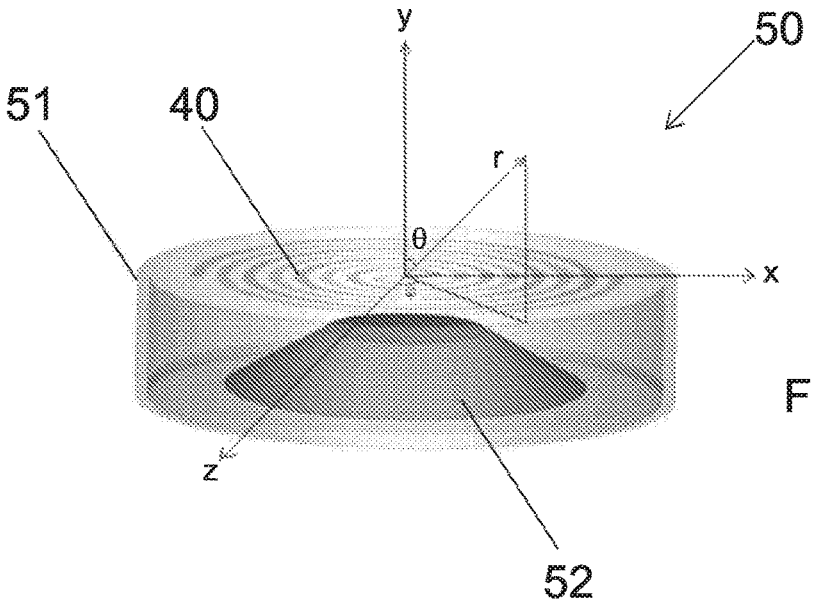
Figure 2a Prior Art
FIG. 2*a* is a perspective view of a cavity backed spiral antenna illustrated in FIG. 1, comprising a PEC cone.
Figure 2B:
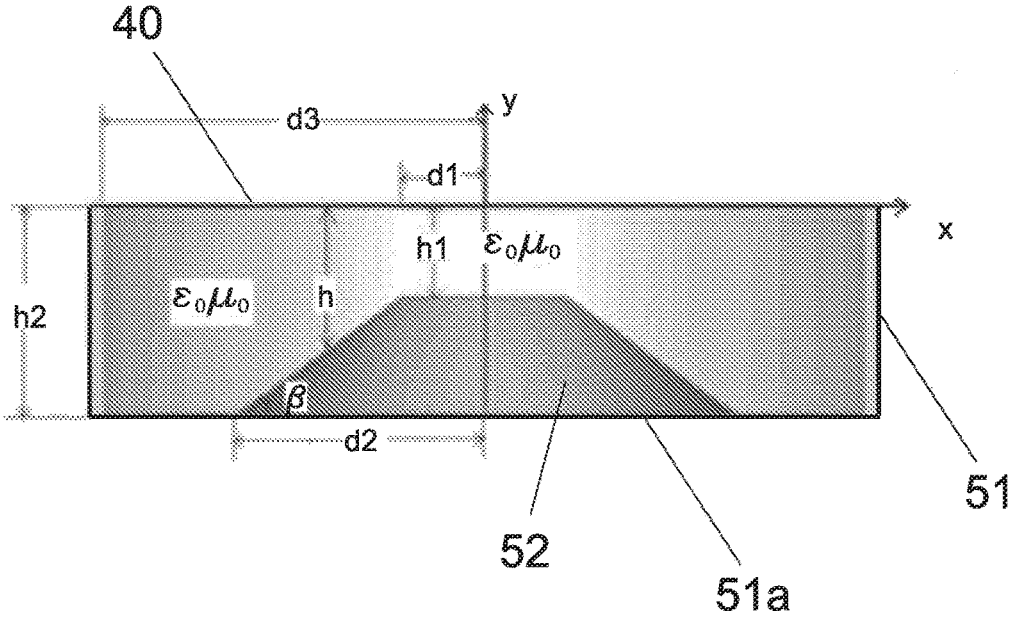
Figure 2b Prior Art
FIG. 2*b* is a sectional view through the cavity backed spiral antenna illustrated in FIG. 2*a;*

In order to create a substrate 60 which offers a similar performance to the conventional cavity backed antenna 50 illustrated in FIG. 2, the above described lens design method 100 may be applied to determine the required material parameters and thus the required variation in permittivity ($\bar{\bar{\varepsilon}}'$) and permeability ($\bar{\bar{\mu}}'$) across the substrate 60. The permittivity ($\bar{\bar{\varepsilon}}'$) and permeability ($\bar{\bar{\mu}}'$) of the transformed space, namely the substrate, is related to the permittivity ($\bar{\bar{\varepsilon}}$) and permeability ($\bar{\bar{\mu}}$) of the original space, namely the cavity backed antenna 40, according to the relationship:

$$\bar{\bar{\varepsilon}}' = \frac{J\bar{\bar{\varepsilon}}J^T}{\det(J)}, \bar{\bar{\mu}}' = \frac{J\bar{\bar{\mu}}J^T}{\det(J)} \tag{6}$$

Figure 7:
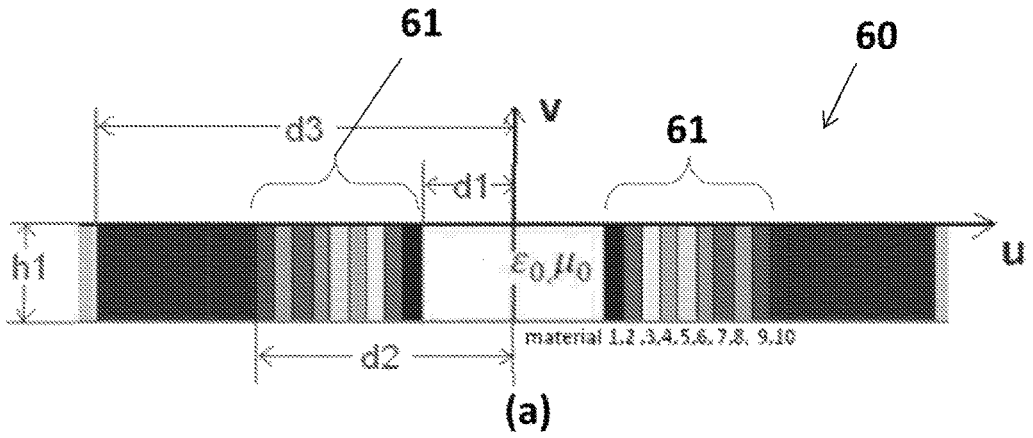
FIG. 7*a* is a sectional view through a radiation source substrate according to an embodiment of the present invention.
FIG. 7*b* is a sectional view through a radiation generating arrangement according to an embodiment of the present invention.
Figure 7:
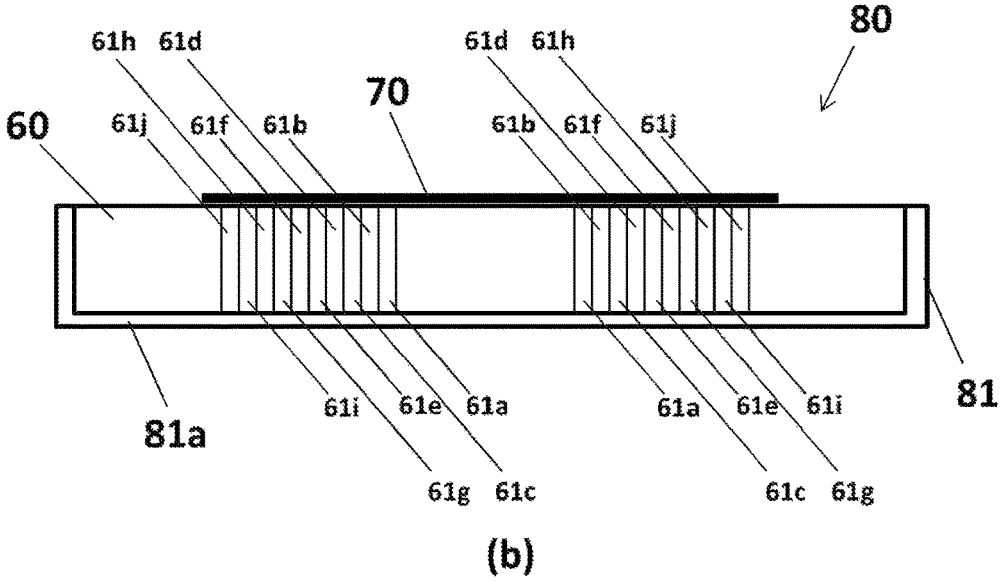

$\bar{\bar{\varepsilon}}$ and $\bar{\bar{\mu}}$ are permittivity and permeability tensors, and J is the Jacobian transformation matrix between the two coordinates systems, namely the (x, y, z) coordinate system in FIG. 2 and the (u, v, w) coordinate system in FIG. 7 and is defined in equation (7) below $$J = \begin{pmatrix} \frac{\partial u}{\partial x} & \frac{\partial u}{\partial y} & \frac{\partial u}{\partial z} \\ \frac{\partial v}{\partial x} & \frac{\partial v}{\partial y} & \frac{\partial v}{\partial z} \\ \frac{\partial w}{\partial x} & \frac{\partial w}{\partial y} & \frac{\partial w}{\partial z} \end{pmatrix} \tag{7}$$

The original permittivity and permeability tensors are defined in equation (8) and (9) as:

$$\bar{\bar{\varepsilon}} = \varepsilon_0 I \tag{8}$$

$$\bar{\bar{\mu}} = \mu_0 I \tag{9}$$

where I is the unitary matrix.

In the 2D case, equation (7) can be simplified as:

$$J = \begin{pmatrix} \frac{\partial u}{\partial x} & \frac{\partial u}{\partial y} \\ \frac{\partial v}{\partial x} & \frac{\partial v}{\partial y} \end{pmatrix} \tag{10}$$

Accordingly, upon substituting equations 8, 9 and 10 into equation 6, the permittivity and permeability tensors of the transformed space can be expressed as:

$$\bar{\bar{\varepsilon}}' = \varepsilon_0 \frac{\begin{pmatrix} \left(\frac{\partial u}{\partial x}\right)^2 + \left(\frac{\partial u}{\partial y}\right)^2 & \frac{\partial u \partial v}{\partial x \partial x} + \frac{\partial u \partial v}{\partial y \partial y} \\ \frac{\partial v \partial u}{\partial x \partial x} + \frac{\partial u \partial v}{\partial y \partial y} & \left(\frac{\partial v}{\partial x}\right)^2 + \left(\frac{\partial v}{\partial y}\right)^2 \end{pmatrix}}{\det(J)} \tag{11}$$

$$\bar{\bar{\mu}}' = \mu_0 \frac{\begin{pmatrix} \left(\frac{\partial u}{\partial x}\right)^2 + \left(\frac{\partial u}{\partial y}\right)^2 & \frac{\partial u \partial v}{\partial x \partial x} + \frac{\partial u \partial v}{\partial y \partial y} \\ \frac{\partial v \partial u}{\partial x \partial x} + \frac{\partial u \partial v}{\partial y \partial y} & \left(\frac{\partial v}{\partial x}\right)^2 + \left(\frac{\partial v}{\partial y}\right)^2 \end{pmatrix}}{\det(J)} \tag{12}$$

The geometry of the cavity backed antenna 40 with PEC cone 52 illustrated in FIG. 2 of the drawings, is completely defined by five parameters. These include the top radius (d1) of the truncated cone 52, the bottom radius (d2) of the PEC cone 52, the radius (d3) of the housing 51 within which the spiral antenna 40 and PEC cone 52 are located, the distance between the spiral plane and the truncated top surface of the PEC cone 52 (h1) and the height of the housing 51 (h2). Since the devices 50, 80 illustrated in FIGS. 2 and 7*b* are symmetrical with their respective vertical axes, only the left halves in FIG. 2 and FIG. 7*b* are considered below.

The mapping relationship between the original (x-y) coordinate system and the new coordinate (u, v) system is described in equation (13), where b is constant and a is the compression ratio in v direction.

$$u = x;\ v = ay + b \tag{13}$$

For x∈[−d1,0], a=1 and for x∈[−d3, −d2], a=0.4804. However, when x∈[−d2, −d1], a it is not a constant value, but rather a variable defined by equation (14):

$$a = \frac{h1}{h1 + |x - (-d1)|.tg\beta} =;\ x \in [-d2, -d1] \tag{14}$$

Within a discretized step $x \in [x_i, x_{i+1}]$, a can be treated as a constant. Accordingly, the following relations can be set:

$$\frac{\partial u}{\partial x} = 1;\ \frac{\partial u}{\partial y} = 0;\ \frac{\partial v}{\partial x} = 0;\ \frac{\partial v}{\partial y} = a \tag{15}$$

Therefore, using equations 10, 11 and 12, the following relations can be derived:

$$J = \begin{pmatrix} \frac{\partial u}{\partial x} & \frac{\partial u}{\partial y} \\ \frac{\partial v}{\partial x} & \frac{\partial v}{\partial y} \end{pmatrix} = \begin{pmatrix} 1 & 0 \\ 0 & a \end{pmatrix} \text{ and } \det(J) = a \tag{16}$$

$$\overline{\overline{\varepsilon'}} = \varepsilon_0 \frac{\begin{pmatrix} \left(\frac{\partial u}{\partial x}\right)^2 + \left(\frac{\partial u}{\partial y}\right)^2 & \frac{\partial u \partial v}{\partial x \partial x} + \frac{\partial u \partial v}{\partial y \partial y} \\ \frac{\partial u \partial v}{\partial x \partial x} + \frac{\partial u \partial v}{\partial y \partial y} & \left(\frac{\partial v}{\partial x}\right)^2 + \left(\frac{\partial v}{\partial y}\right)^2 \end{pmatrix}}{\det(J)} = \varepsilon_0 \frac{\begin{pmatrix} 1 & 0 \\ 0 & a^2 \end{pmatrix}}{a} = \varepsilon_0 \begin{pmatrix} \frac{1}{a} & 0 \\ 0 & a \end{pmatrix} \tag{17}$$

$$\overline{\overline{\mu'}} = \mu_0 \frac{\begin{pmatrix} \left(\frac{\partial u}{\partial x}\right)^2 + \left(\frac{\partial u}{\partial y}\right)^2 & \frac{\partial u \partial v}{\partial x \partial x} + \frac{\partial u \partial v}{\partial y \partial y} \\ \frac{\partial u \partial v}{\partial x \partial x} + \frac{\partial u \partial v}{\partial y \partial y} & \left(\frac{\partial v}{\partial x}\right)^2 + \left(\frac{\partial v}{\partial y}\right)^2 \end{pmatrix}}{\det(J)} = \mu_0 \frac{\begin{pmatrix} 1 & 0 \\ 0 & a^2 \end{pmatrix}}{a} = \mu_0 \begin{pmatrix} \frac{1}{a} & 0 \\ 0 & a \end{pmatrix} \tag{18}$$

The permittivity and permeability tensor components for the substrate can thus be expressed as:

$$\varepsilon'_{uu} = \frac{1}{a} \tag{19}$$

$$\varepsilon'_{vv} = \frac{1}{a} \tag{20}$$

$$\varepsilon'_{ww} = \varepsilon'_{uu} = \frac{1}{a} \tag{21}$$

$$\mu'_{uu} = \frac{1}{a} \tag{22}$$

$$\mu'_{vv} = a \tag{23}$$

$$\mu'_{ww} = \mu'_{uu} = \frac{1}{a} \tag{24}$$

The permittivity and permeability tensors in the thin flat substrate 60 of the radiation generating arrangement 80 are determined by equation (19)-(24). Since the compression ratio a is not a constant when $x \in [-d2, -d1]$, then for practicality reasons, the spatial variation in material properties of the substrate must be discretized if such a device is fabricated. Accordingly, there is a trade-off between the size of the discretization step and the complexity of fabrication, with a smaller step offering a better correlation in the material parameter (and thus refractive index) profile across the substrate with with the derived spatial profile, and thus an improved performance of the arrangement 80 compared with the conventional cavity backed antenna 50, but an increased manufacturing complexity.

The substrate 60 illustrated in FIGS. 7*a* and 7*b* comprises ten concentrically arranged regions 61*a-j* and thus discretisation steps, centred around an axis of the spiral antenna 70, which is disposed thereon. The regions 61*a-j* comprise a respective permittivity and permeability to suitably manipulate the radiation generated from the antenna 70 and which propagates into the substrate 60, to cause the radiation to be reflected therefrom and interfere constructively with the radiation which propagates from the spiral antenna 70, away from the substrate 60. In an embodiment, the substrate is formed of a host material, such as a resin composite which is loaded with a second dispersed material, such as a ceramic powder. The permittivity and permeability of the regions 61*a-j* within the substrate are controlled by controlling the density or filling fraction of the powder within the resin and also the distribution of the powder within the resin, to ensure a substantially homogenous region and thus uniform permittivity and permeability within each region 61*a-j*.

The performance of the radiation generating arrangement 80 according to the above described embodiment, with the substrate 60 being discretised into ten concentric regions 61*a-j*, has been shown to be comparable with the conventional cavity backed antenna 50, but comprises only half the thickness. Accordingly, it is evident that the radiation generating arrangement 80 and substrate 60 provides for an improved control and manipulation of radiation patterns.

What is claimed is:

1. A method for reshaping an actual far-field radiation pattern of a radiation source to a preferred far-field radiation pattern, the method comprising:

determining a preferred far-field radiation pattern of the radiation source;

deriving a corresponding near-field radiation pattern from the preferred far-field radiation pattern;

determining an actual near-field pattern of the radiation source;

mapping an electric field and a magnetic field of the actual near-field radiation pattern to the derived near-field radiation pattern using a transfer relationship, the transfer relationship comprising required material parameters which characterise a lens or substrate, said lens or substrate comprising a host material within which is disposed at least one second, dispersed, particulate material, wherein a dispersal density of the at least one second, dispersed, particulate material varies across the lens or substrate to create a refractive index gradient;

determining the required material parameters;

constructing the lens or substrate according to the required material parameters; and using the lens or substrate to reshape the actual far-field radiation pattern to the preferred far-field radiation pattern.

2. The method according to claim 1, wherein the near-field radiation pattern is derived from the preferred far-field radiation pattern using a mathematical expansion of the electric and magnetic fields of the preferred far-field radiation pattern.

3. The method according to claim 1, wherein the actual near-field radiation pattern is derived from the actual far-field radiation pattern of the radiation source.

4. The method according to claim 3, wherein the actual near-field radiation pattern is derived from the actual far-field radiation pattern using a mathematical expansion of the electric and magnetic fields of the actual far-field radiation pattern.

5. The method according to claim 2, wherein the mathematical expansion comprises a Wilcox expansion.

6. The method according to claim 1, further comprising referencing the determined material parameters to a catalogue to provide a physical material make-up of the lens which provides the preferred far-field radiation pattern.

7. An article of manufacture comprising: non-transient media containing a computer program operable on a computing device so as to cause the computing device to:

derive a near-field radiation pattern corresponding to a preferred far-field radiation pattern;

map an electric field and a magnetic field of an actual near-field radiation pattern to the derived near-field radiation pattern using a transfer relationship, the transfer relationship comprising required material parameters which characterise a lens or substrate, said lens or substrate comprising a host material within which is disposed at least one second, dispersed, particulate material, wherein a dispersal density of the at least one second, dispersed, particulate material varies across the lens or substrate to create a refractive index gradient; and determine the required material parameters.

8. An article of manufacture comprising: a lens or substrate suitable for manipulating at least a portion of a radiation pattern of a radiation source applied to the substrate, the lens or substrate comprising a host material within which is disposed at least one second, dispersed, particulate material, a dispersal density of the at least one second, dispersed, particulate material being varied within the substrate to create a refractive index gradient for manipulating at least a portion of the radiation pattern generated by the radiation source.

9. The article of manufacture according to claim 8, wherein the lens or substrate includes a plurality of concentrically arranged regions centred on an axis of the radiation source, each of the regions comprising material having a respective material property.

10. A radiation generating apparatus comprising a substrate according to claim 8 and a radiation source disposed upon the substrate.

11. The apparatus according to claim 10, wherein the radiation source comprises a spiral antenna.

12. The method of claim 1, wherein the radiation source is a spiral antenna, and determining the material parameters comprises discretizing the lens or substrate into a plurality of concentrically arranged regions, centered around a central axis of the spiral antenna, the regions comprising respective permittivity and permeability to suitably manipulate the radiation generated from the spiral antenna.

13. The article of manufacture of claim 8, wherein the radiation source is a spiral antenna, and the lens or substrate is discretized into a plurality of concentrically arranged regions centered around a central axis of the spiral antenna, the regions comprising respective permittivity and permeability to suitably manipulate the radiation generated from the spiral antenna.

14. The article of manufacture of claim 11, wherein the lens or substrate is discretized into a plurality of concentrically arranged regions centered around a central axis of the spiral antenna, the regions comprising respective permittivity and permeability to suitably manipulate the radiation generated from the spiral antenna.

15. The method of claim 1, wherein the host material of the lens or substrate is a resin, and the at least one second, dispersed, particulate material includes a ceramic powder.

16. The article of manufacture of claim 8, wherein the host material of the lens or substrate is a resin, and the at least one second, dispersed, particulate material includes a ceramic powder.

17. The article of manufacture of claim 10, wherein the host material of the lens or substrate is a resin, and the at least one second, dispersed, particulate material includes a ceramic powder.

* * * * *